US009181945B2

(12) United States Patent
Takeda et al.

(10) Patent No.: US 9,181,945 B2
(45) Date of Patent: Nov. 10, 2015

(54) SCROLL COMPRESSOR WITH CHANNELS INTERMITTENTLY COMMUNICATING INTERNAL AND EXTERNAL COMPRESSION CHAMBERS WITH BACK PRESSURE CHAMBER

(71) Applicant: Hitachi Appliances, Inc., Minato-ku, Tokyo (JP)

(72) Inventors: Hiromu Takeda, Shizuoka (JP); Masashi Miyake, Shizuoka (JP); Masatsugu Chikano, Mito (JP); Masaru Ohtahara, Shizuoka (JP); Shoji Matsumura, Shizuoka (JP)

(73) Assignee: Hitachi Appliances, Inc., Tokyo (JP)

( * ) Notice: Subject to any disclaimer, the term of this patent is extended or adjusted under 35 U.S.C. 154(b) by 3 days.

(21) Appl. No.: 13/764,084

(22) Filed: Feb. 11, 2013

(65) Prior Publication Data

US 2013/0216416 A1 Aug. 22, 2013

(30) Foreign Application Priority Data

Feb. 14, 2012 (JP) ..... 2012-029524

(51) Int. Cl.

| | |
|---|---|
| ***F04C 18/02*** | (2006.01) |
| ***F04C 2/02*** | (2006.01) |
| ***F04C 29/02*** | (2006.01) |
| *F04C 23/00* | (2006.01) |

(52) U.S. Cl.

CPC ..... *F04C 2/02* (2013.01); *F04C 18/0215* (2013.01); *F04C 18/0253* (2013.01); *F04C 18/0261* (2013.01); *F04C 29/028* (2013.01); *F04C 23/008* (2013.01)

(58) Field of Classification Search

CPC .... F04C 18/0253; F04C 29/028; F04C 29/02; F04C 18/0215; F04C 18/0261; F04C 18/0246; F04C 2/02; F04C 2/025; F04C 15/0088

USPC ..... 418/55.2, 55.3, 55.5, 55.1, 55.6, 57

See application file for complete search history.

(56) References Cited

U.S. PATENT DOCUMENTS

| | | | | |
|---|---|---|---|---|
| 4,596,521 | A * | 6/1986 | Murayama et al. | 418/55.1 |
| 5,040,956 | A * | 8/1991 | Barito et al. | 418/1 |
| 5,085,565 | A * | 2/1992 | Barito | 418/55.4 |

(Continued)

FOREIGN PATENT DOCUMENTS

| | | | |
|---|---|---|---|
| JP | 02130284 | A * | 5/1990 |
| JP | 06264876 | A * | 9/1994 |

(Continued)

*Primary Examiner* — Theresa Trieu
*Assistant Examiner* — Xiaoting Hu
(74) *Attorney, Agent, or Firm* — Crowell & Moring LLP

(57) ABSTRACT

The lap shapes of a fixed scroll and an orbiting scroll are configured in an asymmetric tooth profile. In the bed plate of an orbiting scroll, a fluid effluence channel communicating with an external line side compression room of an orbiting scroll lap and another fluid effluence channel communicating with an internal line side compression room are formed, and the outlet side opening of each fluid effluence channel opens in the lap tooth bottom of the orbiting scroll, and inlet side openings are formed in a face of the bed plate that is in sliding contact with the bed plate face of the fixed scroll. In the face of the bed plate, a communicating section control groove that lets the inlet side openings of the two fluid effluence channels and the back pressure room intermittently communicate with each other.

6 Claims, 10 Drawing Sheets

(56) References Cited

U.S. PATENT DOCUMENTS

| | | | | |
|---|---|---|---|---|
| 5,178,527 | A * | 1/1993 | Jung | 418/55.6 |
| 5,249,941 | A * | 10/1993 | Shibamoto | 418/55.5 |
| 5,256,044 | A * | 10/1993 | Nieter et al. | 418/55.5 |
| 5,370,513 | A * | 12/1994 | Fain | 418/55.6 |
| 5,395,224 | A * | 3/1995 | Caillat et al. | 418/55.6 |
| 5,660,539 | A * | 8/1997 | Matsunaga et al. | 418/55.6 |
| 5,810,573 | A * | 9/1998 | Mitsunaga et al. | 418/55.6 |
| 6,422,843 | B1 * | 7/2002 | Sun et al. | 418/55.4 |
| 7,163,386 | B2 * | 1/2007 | Tsuchiya et al. | 418/55.5 |
| 2004/0219048 | A1 * | 11/2004 | Tsuchiya et al. | 418/55.4 |
| 2007/0092390 | A1 * | 4/2007 | Ignatiev et al. | 418/55.5 |
| 2007/0231172 | A1 * | 10/2007 | Fujimura et al. | 418/55.1 |
| 2010/0092321 | A1 * | 4/2010 | Kim et al. | 418/55.6 |
| 2010/0111741 | A1 * | 5/2010 | Chikano et al. | 418/55.2 |
| 2010/0129240 | A1 * | 5/2010 | Shiibayashi et al. | 417/410.5 |
| 2011/0064596 | A1 * | 3/2011 | Yanagase et al. | 418/55.2 |
| 2012/0128518 | A1 * | 5/2012 | Yamada et al. | 418/55.6 |
| 2013/0209303 | A1 * | 8/2013 | Tsuka et al. | 418/55.1 |
| 2014/0010694 | A1 * | 1/2014 | Tsuka et al. | 418/55.2 |

FOREIGN PATENT DOCUMENTS

| | | | |
|---|---|---|---|
| JP | 2010090859 | A * | 4/2010 |
| JP | 2010-203327 | A | 9/2010 |

* cited by examiner

SCROLL COMPRESSOR WITH CHANNELS INTERMITTENTLY COMMUNICATING INTERNAL AND EXTERNAL COMPRESSION CHAMBERS WITH BACK PRESSURE CHAMBER

FIELD OF THE INVENTION

The present invention relates to a scroll compressor to be used as a refrigerant compressor for freezing or air conditioning use or as a gas compressor for compressing air or the like, and more particularly to a scroll compressor having an asymmetric tooth profile in which a compression room formed on the external line side of an orbiting scroll lap and a compression room formed on its internal line side differ in orbiting angle at the time of completion of suction.

BACKGROUND OF THE INVENTION

Known scroll compressors of this kind include, for instance, what is disclosed in Japanese Unexamined Patent Application Publication No. 2010-203327 (Patent document 1). According to this Patent document 1, an oil inlet is formed in the upper face of at least either of an orbiting scroll lap or a fixed scroll lap; a first oil feed channel linking the opening of this oil inlet and a first compression room and a second oil feed channel linking the opening of the oil inlet and a second compression room are formed in the upper face of the lap where the oil inlet is formed; and outlets of the first oil feed channel and of the second oil feed channel are disposed in positions differing in involute angle from each other of the lap where the oil inlet is formed.

This scroll compressor disclosed in Patent document 1 is claimed to be able to uniformly supply sufficient quantities of oil to both the first compression room formed toward the outer wall of the orbiting scroll lap and the second compression room formed toward the inner wall of the same.

However, as the scroll compressor described in the above-cited Patent document 1 has the scroll lap oil inlet for letting fluid in a back pressure room flow out in the upper face (toward the tooth tip) of the scroll lap, a leak loss at the lap tooth tip increases. Furthermore, as oil feed channels for letting fluid in the back pressure room flow out need to be provided within the scroll lap, it involves another problem that the strength of the lap is adversely affected.

It is not impossible to dispense with oil feed channels or an oil inlet in a scroll lap and thereby to avoid a strength loss by providing a scroll compressor having an asymmetric tooth profile with an oil inlet, such as the one mentioned above, which opens toward a tooth bottom between scroll laps of a back pressure room to flow out into a compression room. However, if this configuration is adopted, in order to make the back pressure of the back pressure room communicate with the target pressure level in the compression room on the external line side and the compression room on the internal line side of the orbiting scroll lap will differ in orbiting angle, only one of the external line side compression room and the internal line side compression room can be enabled to communicate with the back pressure room, posing the problem that the compression room not communicating with the oil inlet cannot receive sufficient oil supply.

In order to address the problem noted above, the present invention is intended to provide a scroll compressor that can avoid oiling shortage without sacrificing the lap strength by supplying oil in a back pressure room to both a compression room on the external line side and a compression room on the internal line side of an orbiting scroll lap.

SUMMARY OF THE INVENTION

To achieve the object stated above, the invention provides a scroll compressor comprising a fixed scroll and an orbiting scroll each formed by erecting a spiral lap on a bed plate and meshed with each other to form a suction room and a compression room between the two scrolls, the compression room is compressed by reducing its volume by orbiting the orbiting scroll, and a back pressure room whose internal pressure is higher than the pressure in the suction room is disposed on the rear face of the bed plate of the orbiting scroll, wherein the lap shapes of the fixed scroll and the orbiting scroll are configured in an asymmetric tooth profile in which the external line side compression room formed on the external line side of the orbiting scroll lap and the internal line side compression room formed on the internal line side of the same differ in orbiting angle at the time of completion of suction; a fluid effluence channel for the external line side compression room communicating with the external line side compression room of the orbiting scroll lap and a fluid effluence channel for the internal line side compression room communicating with the internal line side compression room of the orbiting scroll lap are formed on the bed plate of the orbiting scroll; the outlet side opening of each of the fluid effluence channels is so formed as to open in the lap tooth bottom of the orbiting scroll that constitutes the compression room; the inlet side opening of each of the fluid effluence channels is so formed as to open in the bed plate face of the orbiting scroll that slides in contact with the bed plate sliding face of the fixed scroll; and, in the face of the bed plate of the fixed scroll in contact with the bed plate of the orbiting scroll, a communicating section control groove that lets the back pressure room and the external line side compression room intermittently communicate with each other by letting the inlet side opening of the fluid effluence channel for the external line side compression room and the back pressure room intermittently communicate with each other along with the orbiting motion of the orbiting scroll, and a communicating section control groove that lets the back pressure room and the internal line side compression room intermittently communicate with each other by letting the inlet side opening of the fluid effluence channel for the internal line side compression room and the back pressure room intermittently communicate with each other along with the orbiting motion of the orbiting scroll are provided, the communicating section control groove that lets the back pressure room and the external line side compression room intermittently communicate with each other and the communicating section control groove that lets the back pressure room and the internal line side compression room intermittently communicate with each other are formed of a common single groove, and the respective inlet side openings of the two fluid effluence channels are separated by a distance that is smaller than a length of a radius of a circumference defined by the bed plate of the orbiting scroll, so that the respective inlet side openings of the two fluid effluence channels are adjacent to one another.

According to the invention, it is possible to obtain a scroll compressor that can avoid oiling shortage without sacrificing the lap strength by supplying oil from a back pressure room to both the compression room on the external line side and the compression room on the internal line side of the orbiting scroll lap.

DETAILED DESCRIPTION OF THE PREFERRED EMBODIMENTS

Specific embodiments of the present invention will be described below with reference to the accompanying drawings.

First Embodiment

A scroll compressor, which is a first embodiment of the invention, will be described below with reference to FIG. 1 through FIG. 4.

Figure 1:
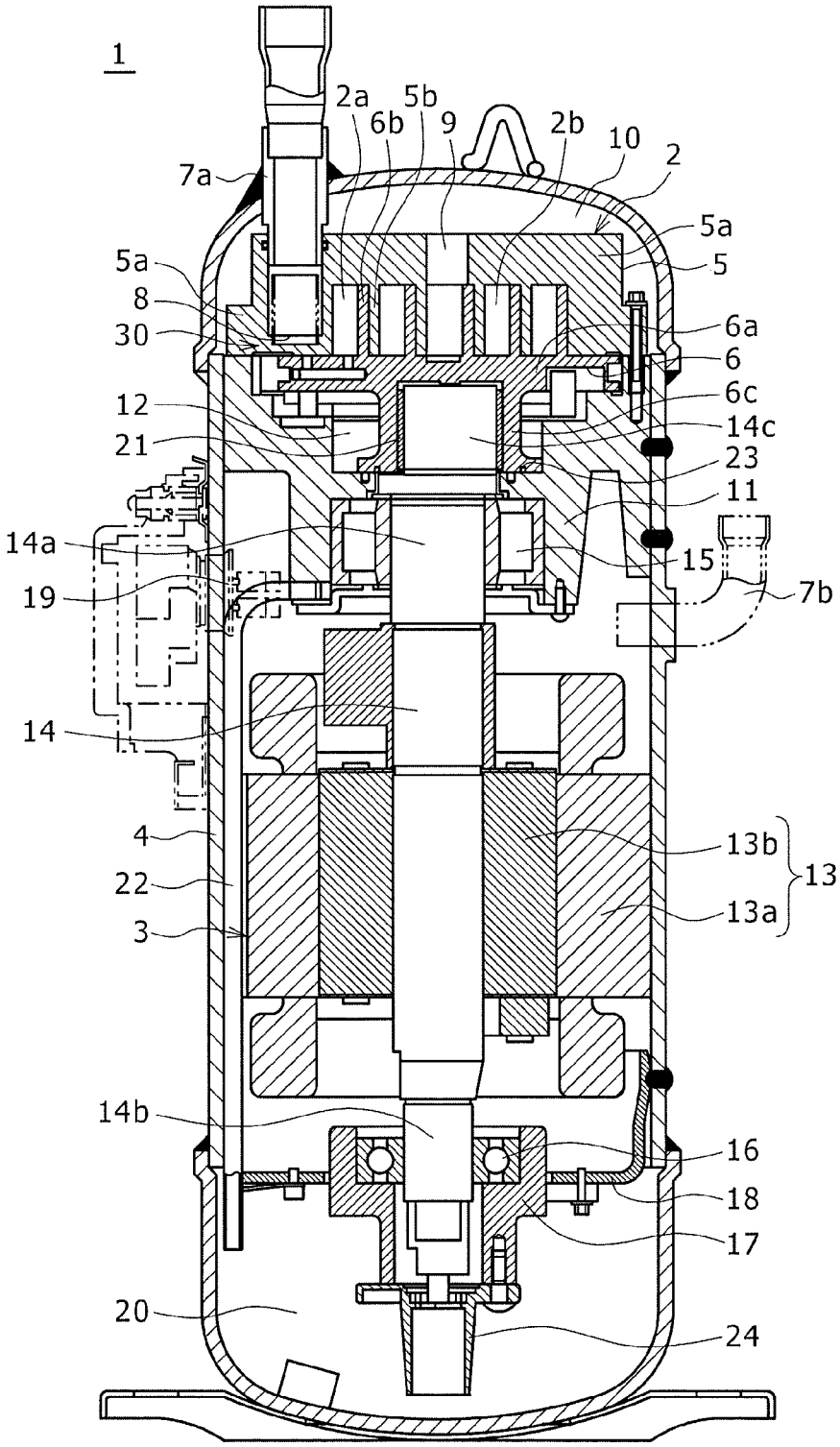
FIG. 1 shows a vertical section of a scroll compressor, which is a first embodiment of the present invention.

FIG. 1 shows a vertical section of the scroll compressor, which is the first embodiment of the invention, revealing the overall structure of the scroll compressor. A scroll compressor 1 of this embodiment is configured by housing a compressing unit 2 that is arranged in the upper part and a drive unit 3 that is arranged in the lower part and drives the compressing unit in a sealed vessel 4.

The compressing unit 2 is configured by meshing with each other a fixed scroll 5 formed by erecting a spiral lap 5*b* on a bed plate 5*a* and an orbiting scroll 6 formed by erecting a spiral lap 6*b* on a bed plate 6*a*. This configuration lets the external line side compression room 2*a* of the orbiting scroll lap 6*b* and the internal line side compression room 2*b* be formed between the two scrolls 5 and 6. By causing the orbiting scroll 6 to be orbited by the drive unit 3, working fluid (e.g. gas refrigerant) is sucked into the compression rooms 2*a* and 2*b* from an intake pipe 7*a* via an intake space 8, and the working gas is compressed by the resultant capacity decreases of the compression rooms 2*a* and 2*b* to be discharged from a discharge port 9 at the center into a discharge space 10. This working gas discharged into the discharge space 10 flows into a space in which the drive unit 3 is arranged via a passage (not shown) formed between a frame 11 to which the fixed scroll 5 of the compressing unit 2 is fitted and the sealed vessel 4 to which this frame 11 is fixed, and discharged outside the sealed vessel 4 via a discharge pipe 7*b* disposed on the sealed vessel 4.

Between the bed plate 6*a* of the orbiting scroll 6 and the frame 11, namely on the rear face of the bed plate of the orbiting scroll 6, there is formed a back pressure room 12 in which the pressure is higher than that in the intake space 8 and lower than that in the discharge space 10.

The drive unit 3 is configured of such basic elements as an electric motor 13 comprising a stator 13*a* and a rotor 13*b*, a crankshaft 14 integrally coupled to the center of the rotor 13*b*, a main bearing 15 that is disposed on the frame 11 and rotationally supports a main shaft part 14*a* toward the upper side of the crankshaft 14, a secondary bearing 16 that supports a secondary shaft part 14*b* toward the lower side of the crankshaft 14, a secondary shaft housing 17 provided with this secondary bearing 16, and a secondary frame 18 fitted with this secondary shaft housing 17 and fixed to the sealed vessel 4.

The electric motor 13 is driven by an electrical input supplied from an inverter (not shown) or the like via an electrical terminal 19, and rotates the crankshaft 14. An eccentric shaft part 14*c* is provided toward the upper end of this crankshaft 14, and this eccentric shaft part 14*c* is inserted into an orbiting boss part 6*c* disposed at the center of the fear face of the orbiting scroll 6 to orbit the orbiting scroll 6.

In the lower part of the sealed vessel 4, an oil sump 20 to keep lubricating oil (hereinafter to be sometimes referred to as simply "oil") is formed. Oil in this oil sump 20 is placed under discharging pressure, and oil in the oil sump 20 is supplied, by utilizing the pressure difference from the suction side of the compressor, via an oil feed channel (not shown) formed in the crankshaft 14 to a space (orbiting boss part space) in the orbiting boss part 6*c* between the orbiting boss part 6*c* of the orbiting scroll 6 and the eccentric shaft part 14*c*. The oil supplied to this orbiting boss part space, after lubricating an orbit bearing 21 disposed on the orbiting boss part 6*c*, flows to the main bearing 15, and the oil after lubricating the main bearing 15 is returned to the oil sump 20 via a drain oil pipe 22.

Part of the oil in the orbiting boss part space is supplied to the back pressure room 12 via an oil conveying mechanism 23, such as a differential pressure oil feed mechanism utilizing a seal disposed between the lower end face of the orbiting boss part 6*c* and the frame 11 and a pressure difference. It is so configured that the oil supplied to this back pressure room 12 is supplied to the compression rooms 2*a* and 2*b* via a back pressure room fluid effluence mechanism unit 30 formed on the bed plate 5*a* of the fixed scroll 5 and the bed plate 6*a* of the orbiting scroll 6.

In the compressive action of the scroll compressor 1, it is necessary to maintain the tightly sealed state of the compression rooms 2*a* and 2*b* by pressing the orbiting scroll 6 against the fixed scroll 5, and for this purpose the pressure (back pressure) level of the back pressure room 12 is kept between the discharge pressure and the suction pressure (namely an intermediate pressure lower than the discharge pressure and higher than the suction pressure). This enables the intermediate pressure to work on the rear face of the bed plate 6*a* of the orbiting scroll 6, making it possible to press the orbiting scroll 6 against the fixed scroll 5 at an appropriate pressure level.

In this embodiment, to make the pressure in the back pressure room 12 appropriate, it is so intended, when the pressure states in the compression rooms 2*a* and 2*b* enter into the target pressure range, as to let the compression rooms 2*a* and 2*b* and the back pressure room 12 in that pressure range communicate with each other via the back pressure room fluid effluence mechanism unit 30. This enables the back pressure room 12 to be kept at the targeted appropriate pressure level and to prevent a reverse flow (reverse flow from the high pressure side to the low pressure side) of the working gas due to an insufficient force of pressing the orbiting scroll 6 against the fixed scroll 5 and the resultant loss of energy. Also, an increase in sliding loss (energy loss) due to an excessive pressing force can be avoided. Furthermore, since oil can be securely supplied to both the external line side compression room 2*a* and the internal line side compression room 2*b*, lubrication of the sliding parts of the fixed scroll 5 and the orbiting scroll 6 can also be securely accomplished to prevent short supply of oil. Therefore, the reliability of the scroll compressor can be ensured.

As described so far, oil in the oil sump 20 not only is supplied to and lubricate the bearings 15, 16 and 21 but also lubricate the sliding parts of the fixed scroll 5 and the orbiting scroll 6 by being supplied to the compression rooms 2*a* and 2*b*, and further seals the sliding parts of the fixed scroll 5 and the orbiting scroll 6. This sealing action can restrain heating of the working gas in the compression rooms and recompression of the working gas by leaks of the working fluid in the compression rooms 2*a* and 2*b* to the low-pressure side compression room, thereby reducing the energy losses that may ensue.

Incidentally, reference numeral 24 denotes a displacement type oil feed pump, which is provided to apply pressure to make up for insufficiency in supplying oil from the oil sump 20 to the orbiting boss space or to supply oil to the secondary bearing 16.

Further, in the scroll compressor 1 of this embodiment, the lap shapes of the fixed scroll 5 and the orbiting scroll 6 are configured in an asymmetric tooth profile in which the external line side compression room 2*a* formed on the external line side of the orbiting scroll lap 6*b* and the internal line side compression room 2*b* formed on the internal line side of the same differ in orbiting angle at the time of the completion of suction. In the scroll compressor having this asymmetric tooth profile, the enclosed volume of the external line side compression room 2*a* of the orbiting scroll lap 6*b* is greater than the enclosed volume of the internal line side compression room 2*b* of the same. For this reason, the compression rooms (compression rooms in the target pressure state) 2*a* and 2*b* which are placed in a mutually communicated state to set the pressure of the back pressure room 12 to the targeted level differ in orbiting angle between the external line side compression room 2*a* and the internal line side compression room 2*b* of the orbiting scroll lap 6*b*.

Figure 2:
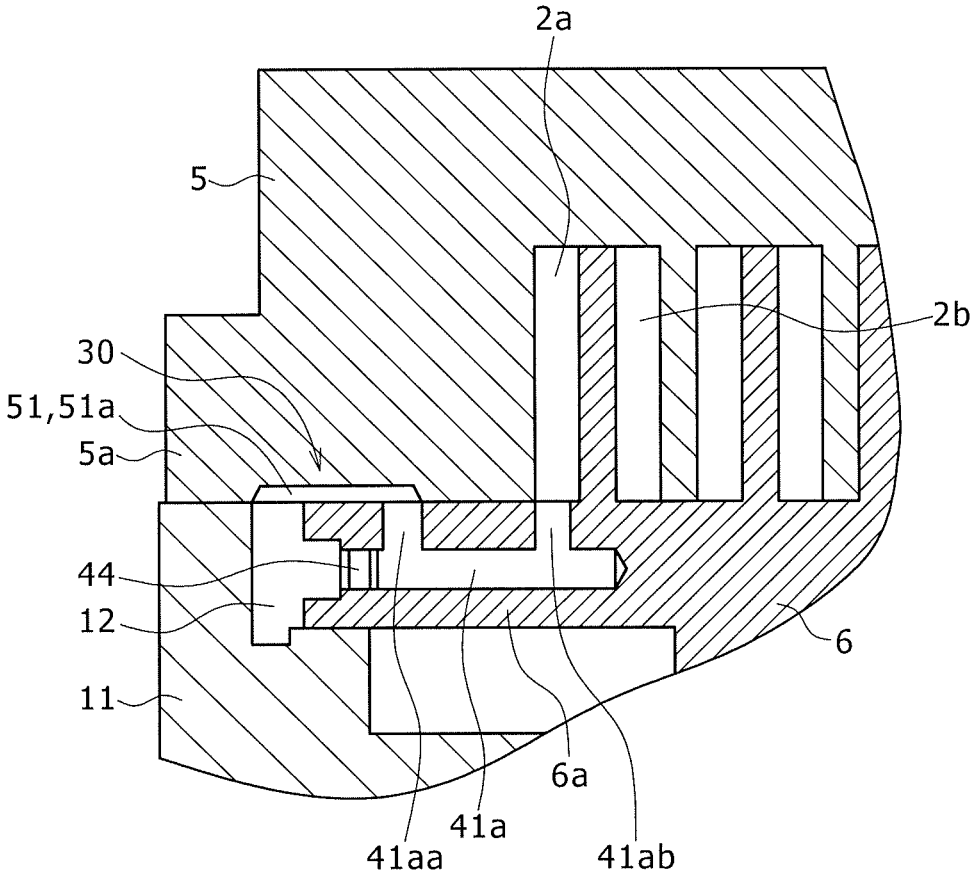
FIG. 2 is an enlarged view of a section of an essential part of the vicinities of a back pressure room fluid effluence mechanism illustrated in FIG. 1.
Figure 3:
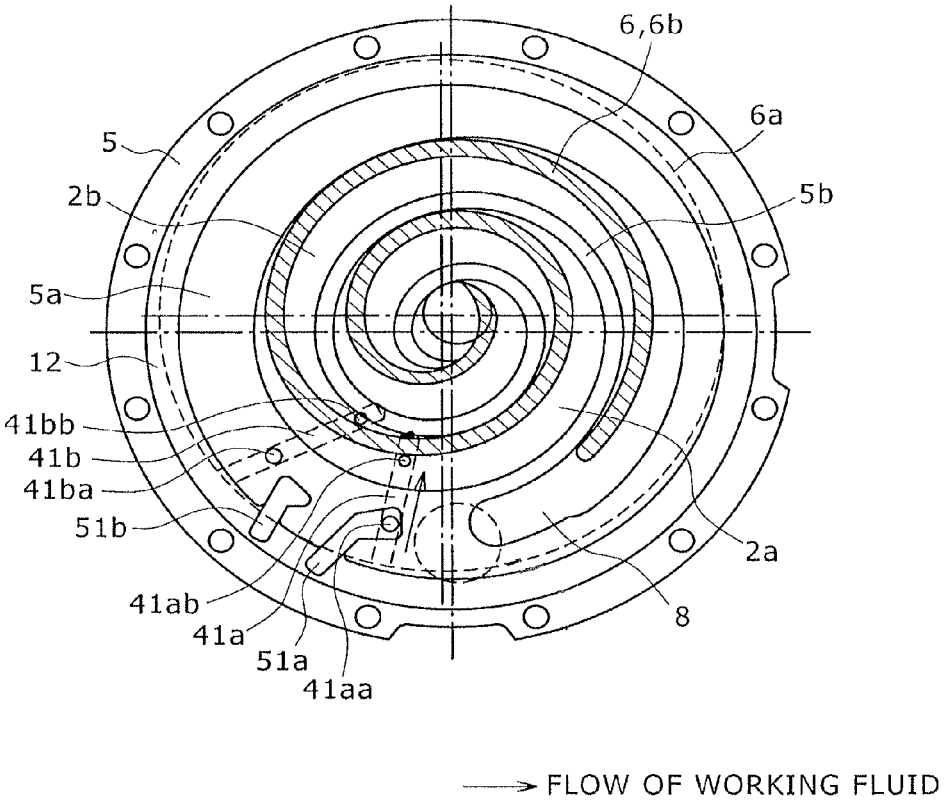
FIG. 3 is a sectional view of a state in which the fixed scroll and the orbiting scroll of the scroll compressor shown in FIG. 1 are meshed with each other and the back pressure room and the external line side compression room communicate with each other.
Figure 4:
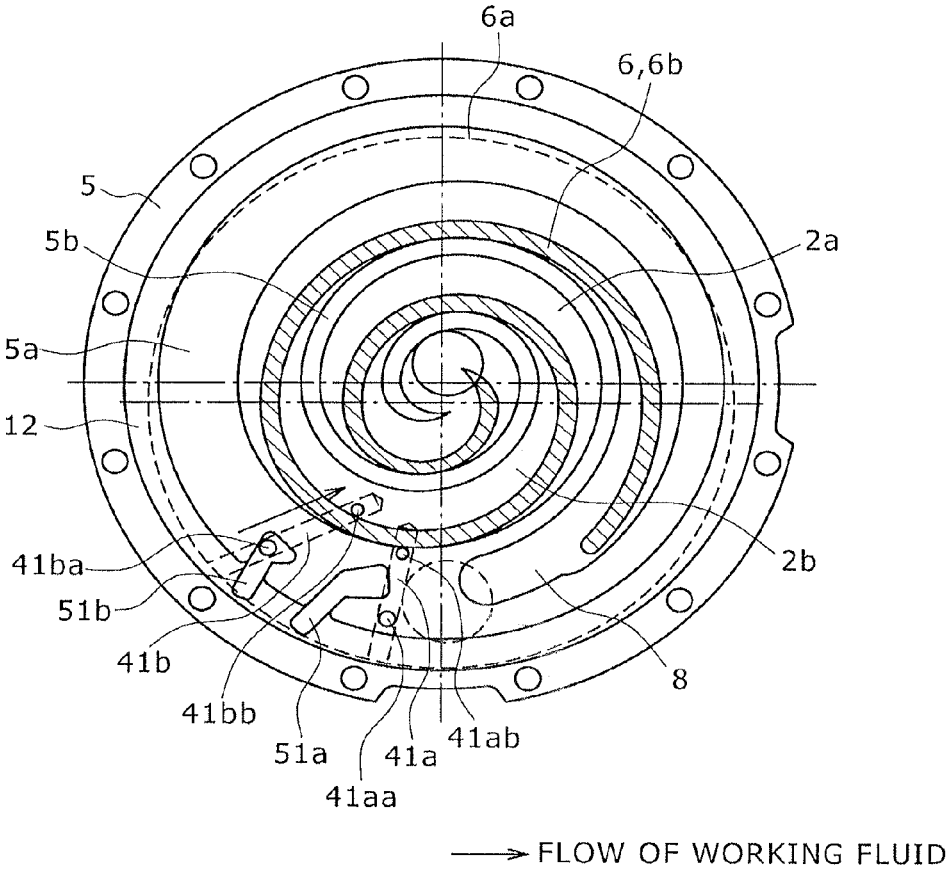
FIG. 4 is a sectional view of a state in which the fixed scroll and the orbiting scroll of the scroll compressor shown in FIG. 1 are meshed with each other and the back pressure room and the internal line side compression room communicate with each other.

The configuration of the back pressure room fluid effluence mechanism unit 30 will now be described in detail with reference to FIG. 2 through FIG. 4. FIG. 2 is an enlarged view of a section of an essential part of the vicinities of the back pressure room fluid effluence mechanism unit 30 illustrated in FIG. 1; FIG. 3 and FIG. 4 are sectional view showing a state in which the fixed scroll and the orbiting scroll of the scroll compressor shown in FIG. 1 are meshed with each other, FIG. 3 showing a state in which the back pressure room and the external line side compression room communicate with each other and FIG. 4, a state in which the back pressure room and the internal line side compression room communicate with each other.

As shown in FIG. 2 through FIG. 4, in the bed plate 6*a* of the orbiting scroll 6, a fluid effluence channel 41*a* for the external line side compression room that communicates with the external line side compression room 2*a* of the orbiting scroll lap 6*b* and a fluid effluence channel 41*b* for the internal line side compression room that communicates with the internal line side compression room 2*b* of the orbiting scroll lap 6*b* (see FIG. 3 and FIG. 4) are formed. In the fluid effluence channels 41*a* and 41*b*, inlet side openings 41*aa* and 41*ba* and outlet side openings 41*ab* and 41*bb* are formed. To add, reference numeral 44 in FIG. 2 denotes a blocking member that blocks the open end occurring when the fluid effluence channel 41*a* is formed (also true of 41*b*) to prevent the fluid effluence channel 41*a* from communicating with the back pressure room 12 all the time.

The outlet side opening 41*ab* of the fluid effluence channel 41*a* for the external line side compression room is formed in the lap tooth bottom, which constitutes the external line side compression room 2*a*, of the orbiting scroll 6, and the outlet side opening 41*bb* of the fluid effluence channel 41*b* for the internal line side compression room is formed in the lap tooth bottom, which constitutes the internal line side compression room 2*b*, of the orbiting scroll 6.

The inlet side openings 41*aa* and 41*ba* of the fluid effluence channels 41*a* and 41*b* are so formed as to open in a face of the bed plate 6*a* of the orbiting scroll 6 that slides in contact with a sliding face of the bed plate 5*a* of the fixed scroll 5.

On the other hand, the bed plate 5*a* of the fixed scroll 5 has communicating section control grooves 51 (51*a* and 51*b* (for 51*b*, see FIG. 3 and FIG. 4)) formed in its face in contact with the bed plate 6*a* of the orbiting scroll 6. The communicating section control groove 51*a* is formed in a position where the inlet side opening 41*aa* of the fluid effluence channel 41*a* for the external line side compression room and the back pressure room 12 are let communicate intermittently with each other along with the orbiting motion of the orbiting scroll, and the communicating section control groove 51*b* is formed in a position where the inlet side opening 41*ba* of the fluid effluence channel 41*b* for the internal line side compression room and the back pressure room 12 are let communicate intermittently with each other along with the orbiting motion of the orbiting scroll. In this way, the back pressure room 12, the external line side compression room 2*a*, and the external line side compression room 2*b* can be let communicate intermittently with each other. Incidentally in this embodiment, the communicating section control grooves 51*a* and 51*b* are two separate grooves not communicating with each other.

Thus, the inlet side openings 41*aa* and 41*ba* of the fluid effluence channels 41*a* and 41*b* are blocked by the bed plate 5*a* of the fixed scroll 5 in some sections along with the orbiting motion of the orbiting scroll 6, and communication between the back pressure room 12 and the compression room 2*a* or 2*b* is obstructed. In some other sections, the presence of the inlet side opening 41*aa* or 41*ba* in a position where the communicating section control groove 51 (51*a* or 51*b*) is formed in the bed plate 5*a* of the fixed scroll 5 enables the back pressure room 12 and the compression room 2*a* or 2*b* to communicate with each other.

The position of formation and the shape of the communicating section control grooves 51 (51*a* or 51*b*) are so determined that only in sections where the pressure level of the external line side compression room 2*a* or the internal line side compression room 2*b* is equivalent to the target pressure level the compression room 2*a* or 2*b* and the back pressure room 12, whose pressure level is equal to the target pressure level, communicate with each other via the fluid effluence channel 41*a* or 41*b* (see FIG. 3 or FIG. 4).

As oil from the oil sump 20 under a pressure substantially equal to the discharge pressure is let flow into the back pressure room 12 by the oil conveying mechanism 23, such as a differential pressure oil feeding mechanism, provided on the orbiting scroll 6, the pressure in the back pressure room 12 tends to become equal to the discharge pressure. However, the back pressure room 12 and the compression rooms 2*a* and 2*b* via the fluid effluence channels 41*a* and 41*b* and the communicating section control grooves 51 (51*a* and 51*b*) are let intermittently communicate with each other, oil in the back pressure room 12 and working fluid, such as working gas, are supplied into the compression rooms 2*a* and 2*b* by the pressure difference between the pressure in the back pressure room 12 and that in the compression rooms 2*a* and 2*b* in a communicating state. This causes the pressure in the back pressure room 12 to be kept substantially equal to that in the compression rooms 2*a* and 2*b*.

Figure 5:
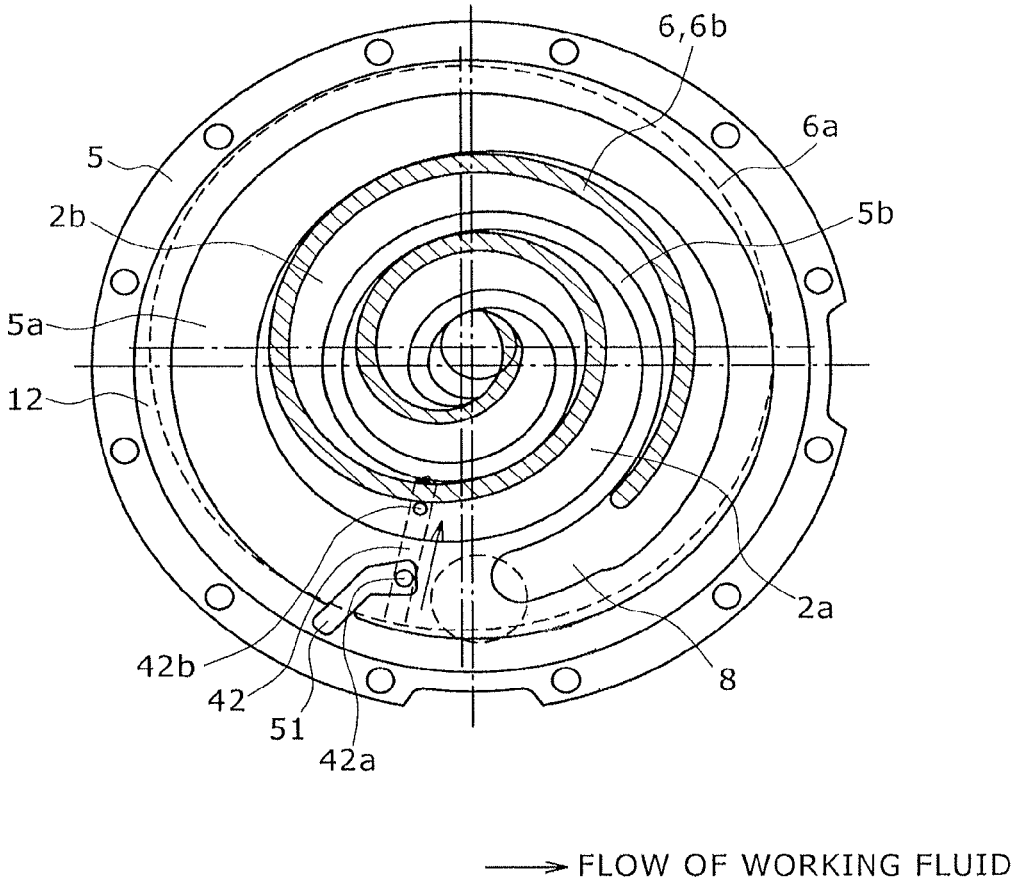
FIG. 5 is a sectional view of a state in which the fixed scroll and the orbiting scroll of an initially studied scroll compressor are meshed with each other and the back pressure room and the external line side compression room communicate with each other.
Figure 6:
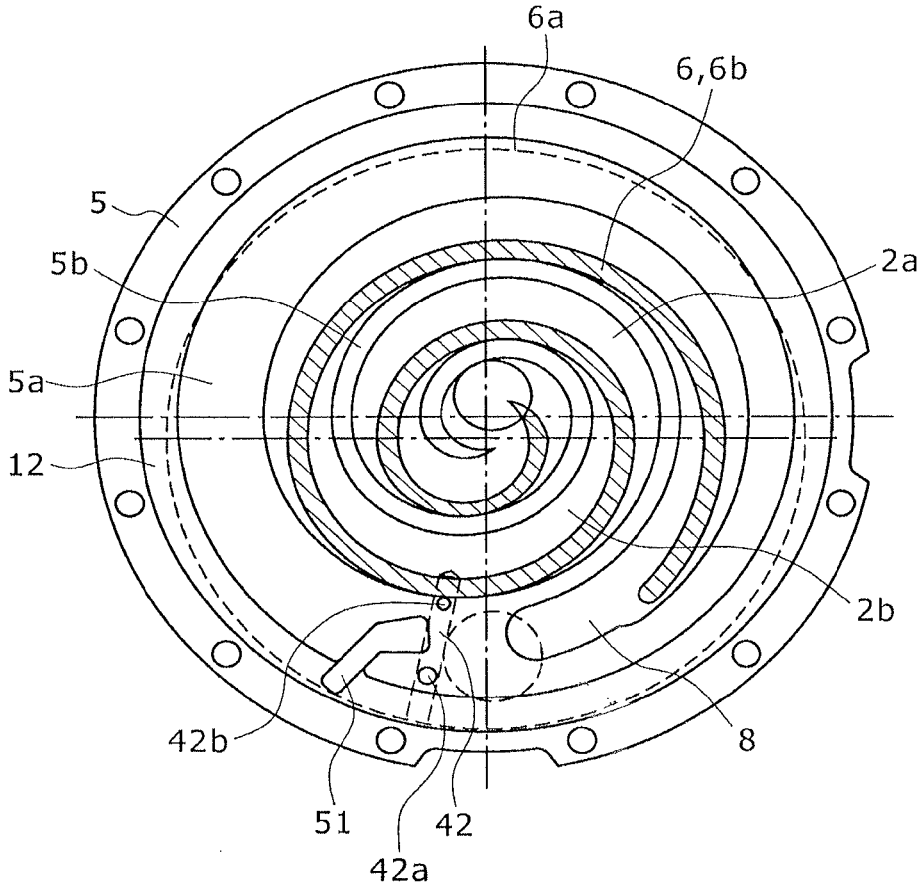
FIG. 6 is a sectional view of a state in which the fixed scroll and the orbiting scroll of the initially scroll compressor are meshed with each other and the back pressure room and the external line side compression room do not communicate with each other.

Hereupon, an example of configuration of a back pressure room scroll compressor mechanism in an initially studied scroll compressor scroll compressor will be described with reference to FIG. 5 and FIG. 6. FIG. 5 and FIG. 6 are sectional views of a state in which the fixed scroll and the orbiting scroll in this scroll compressor are meshed with each other, FIG. 5 showing a state in which the back pressure room and the external line side compression room communicate with each other and FIG. 6, a state in which the fixed scroll and the orbiting scroll of the back pressure room and the external line side compression room do not communicate with each other. In these drawings, parts denoted by respectively the same reference signs in FIG. 3 and FIG. 4 above are respectively the same or equivalent parts.

The scroll compressor shown in FIG. 5 and FIG. 6 also has an asymmetric tooth profile in which the external line side compression room 2*a* and the internal line side compression room 2*b* of the orbiting scroll 6 differ in orbiting angle at the time of the completion of suction. Ina scroll compressor having such an asymmetric tooth profile, as stated above, pressures in the external line side compression room 2*a* and in the internal line side compression room 2*b* at a certain orbiting angle differ from each other. As a result, in a configuration in which the back pressure room 12 and the compression rooms 2*a* and 2*b* communicate with each other via a single fluid effluence channel 42, there occurs a section or sections where a back pressure room 21 communicates with each of the compression rooms 2*a* and 2*b* at the same time. If the compression room rooms 2*a* and 2*b* communicate with the back pressure room 12 at the same time, oil in the back pressure room 12 can be supplied to only the low pressure side oil in the back pressure room 12 out of the compression rooms 2*a* and 2*b*. Thus, as the high pressure side compression room communicates with the low pressure side compression room, too, working gas and oil (working fluid) in the high pressure side compression room flows out toward the low pressure side compression room or toward the back pressure room 12. This gives rise to problems that no oil is supplied to the high pressure side compression room, the effluence of the working fluid toward the low pressure invites insufficient compression, and the working fluid having flowed out to the low pressure side compression room is compressed again, resulting in a decline in compression efficiency.

In the configuration initially conceived to prevent this trouble, an inlet side opening 42*a* of the fluid effluence channel 42 intermittently communicates with the communicating section control grooves 51, and only one outlet side opening 42*b* is provided for the channel 42 to let it communicate only with the external line side compression room 2*a* as shown in FIG. 5 and FIG. 6. In this configuration shown in FIG. 5 and FIG. 6, however, oil cannot be supplied from the back pressure room 12 to the internal line side compression room 2*b* having no outlet side opening 42*b* for the fluid effluence channel 42, resulting in a shortage of oil supply. Moreover, since the back pressure room 12 communicates only with the compression room 2*a*, but not with the compression room 2*b*, the sections in which communication is established between the back pressure room 12 and the compression rooms are shortened, with a consequence of greater pressure fluctuations in the back pressure room 12.

Unlike in the initially conceived configuration, in this embodiment not only the fluid effluence channel 41*a* for the external line side compression room which communicates with the external line side compression room 2*a* and the fluid effluence channel 41*b* for the internal line side compression room which communicates with the internal line side compression room 2*b* are formed on the bed plate 6*a* of the orbiting scroll 6, but also the bed plate 5*a* of the fixed scroll 5 is provided with the communicating section control grooves 51*a* and 51*b* that intermittently communicate with the respective inlet side openings 41*aa* and 41*ba* of the fluid effluence channels 41*a* and 41*b* along with the orbiting motion of the orbiting scroll as described above. And the communicating section control grooves 51*a* and 51*b* are so configured that the fluid effluence channels 41*a* and 41*b* communicate with the communicating section control grooves 51*a* and 51*b* only within the range in which the compression rooms 2*a* and 2*b* are at the target pressure level.

Thus in this embodiment, the communicating section control grooves 51*a* and 51*b* are so formed that the back pressure room 12, the external line side compression room 2*a*, and the internal line side compression room 2*b* intermittently communicate with each other only in the orbiting angle where the pressure in each compression room takes on the target pressure level. Also in this embodiment, the communicating section control groove 51*a* that lets the back pressure room 12 and the external line side compression room 2*a* intermittently communicate with each other and the communicating section control groove 51*b* that lets the back pressure room 12 and the internal line side compression room 2*b* intermittently communicate with each other are two separate grooves which do not communicate with each other.

Further in this embodiment, as the two communicating section control grooves 51*a* and 51*b* are so formed that the external line side compression room 2*a* and the internal line side compression room 2*b* do not communicate with the back pressure room 12 at the same time, it is made possible to reliably supply oil from the back pressure room 12 to both the external line side compression room 2*a* and the internal line side compression room 2*b*, and short supply of oil can be thereby prevented. Also, as the back pressure room 12 communicates with both compression rooms 2*a* and 2*b*, the sections in which communication is established between the back pressure room 12 and one of the compression rooms can be extended, thereby to reduce pressure fluctuations in the back pressure room 12.

Figure 7:
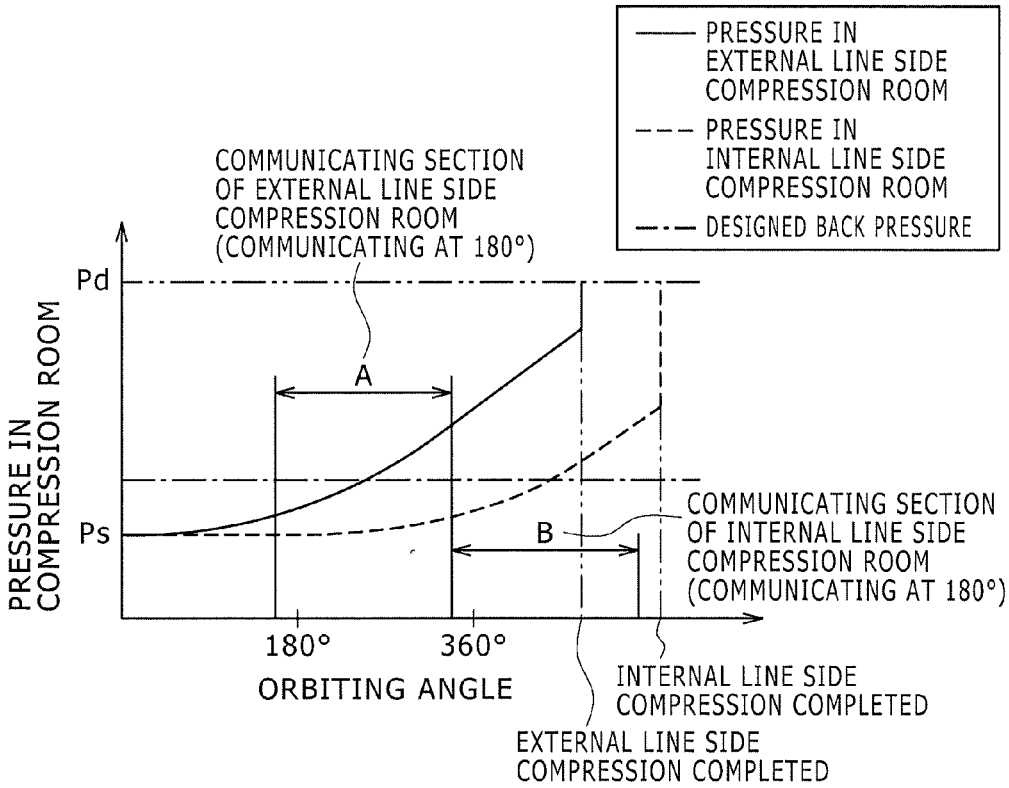
FIG. 7 is a diagram illustrating one example of relationship between the orbiting angle and the pressure in the compression room in the scroll compressor according to the invention.
Figure 8:
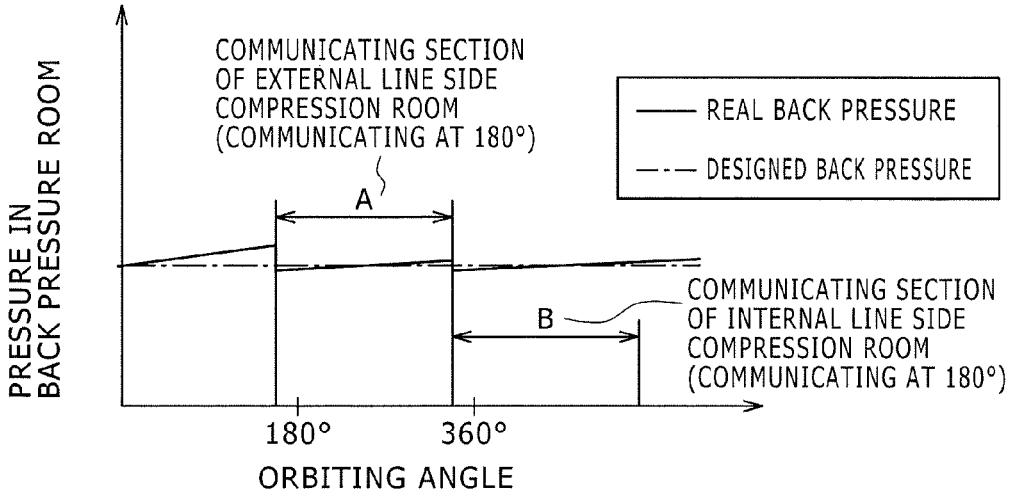
FIG. 8 is a diagram illustrating one example of relationship between the orbiting angle and the back pressure room in the scroll compressor according to the invention.

FIG. 7 is a diagram illustrating one example of relationship between the orbiting angle and the pressure in the compression room in the scroll compressor according to the invention, and FIG. 8, a diagram illustrating one example of relationship between the orbiting angle and the back pressure room in the same.

In FIG. 7, a solid line represents pressure variations in the external line side compression room 2*a* relative to the orbiting angle of the orbiting scroll 6, a broken line, pressure variations in the internal line side compression room 2*b* on the same basis, and a dashed line, a designed pressure (designed back pressure) in the back pressure room 12. Ps denotes a suction pressure and Pd, a discharge pressure. In this example, the position of formation and the shape of the communicating section control grooves 51*a* and 51*b* are so determined as to let the external line side compression room 2*a* communicate with the back pressure room 12 in Section A (the communicating section is approximately 180° in this embodiment) in which its target pressure range (a range of pressure substantially equal to the designed back pressure) is achieved, and to let the internal line side compression room 2*b* communicate with the back pressure room 12 in Section B (the communicating section is approximately 180° in this embodiment) in which its target pressure range is achieved.

By adopting this configuration shown in FIG. 7, the pressure in the back pressure room 12 relative to the orbiting angle of the orbiting scroll 6 varies as shown in FIG. 8. In FIG. 8, a solid line represents the real pressure in the back pressure room 12 (real back pressure), and a dashed line, the designed pressure in the back pressure room 12 (designed back pressure). In this embodiment, since the back pressure room 12 communicates with the compression room 2*a* in Communicating Section A and with the compression room 2*b* in Communicating Section B as shown in FIG. 7, the back pressure room 12 and the compression room can be let communicate with each other in a broad combined section. For this reason, pressure fluctuations in the back pressure room 12 can be reduced and maintained at a level substantially equal to the designed back pressure as shown in FIG. 8.

Figure 9:
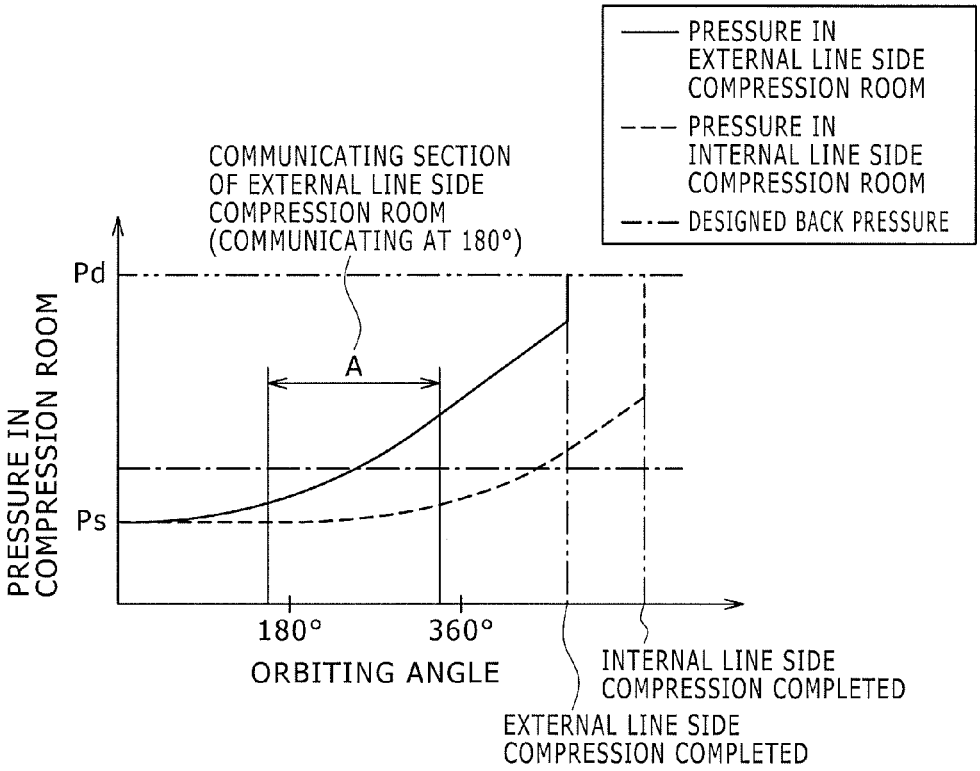
FIG. 9 is a diagram illustrating the relationship between the orbiting angle and the pressure in the compression room of the initially studied scroll compressor.
Figure 10:
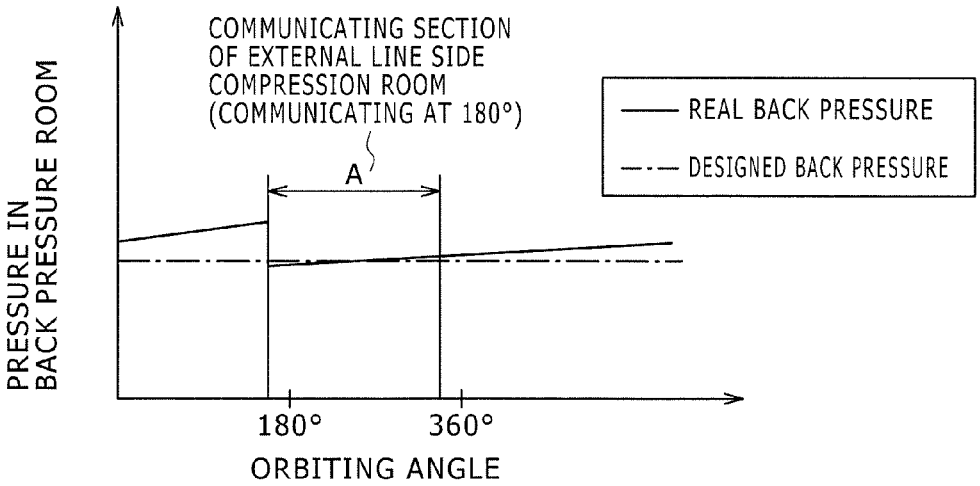
FIG. 10 is a diagram illustrating the relationship between the orbiting angle and the back pressure room of the initially studied scroll compressor.

FIG. 9 is a diagram illustrating the relationship between the orbiting angle and the pressure in the compression room in the scroll compressor described with reference to FIG. 5 and FIG. 6, and FIG. 10, a diagram illustrating the relationship between the orbiting angle and the pressure in the back pressure room in the same. In FIG. 9 and FIG. 10, the solid line, broken line, dashed line, Ps, and Pd denote the same as their respective counterparts in FIG. 7 and FIG. 8.

As shown in FIG. 9, the back pressure room 12 communicates with only the compression room 2*a* in Communicating Section A but not with the compression room 2*b* in the scroll compressor illustrated in FIG. 5 and FIG. 6, and therefore the back pressure room 12 and any compression room can be let communicate with each other only in a narrow section, about half as wide as in this embodiment. As a consequence, as shown in FIG. 10, pressure fluctuations in the back pressure room 12 increases, resulting in a considerably higher level than the designed back pressure. Therefore, the force of pressing the orbiting scroll 6 against the fixed scroll 5 increases, and invites a greater sliding friction loss.

As hitherto described, since the overall communicating section in this embodiment between the back pressure room 12 and any compression room can be made wider than in the configuration shown in FIG. 5 and FIG. 6, pressure fluctuations in the back pressure room can be restrained to maintain a stable back pressure. The stabilization of the back pressure results in a more stable force of pressing the orbiting scroll 6, uniformized facial pressures of the sliding faces of the fixed scroll 5 and of the orbiting scroll 6, and a reduced sliding friction loss, also enabling the reliability of the sliding faces to be enhanced.

Further, Communicating Sections A and B of the two fluid effluence channels 41*a* and 41*b* are set as shown in FIG. 7 to prevent these two fluid effluence channels 41*a* and 41*b* from communicating at the same time. Therefore, since the compression rooms 2*a* and 2*b* never communicate with the back pressure room 12 at the same time, working fluid, such as compressed gas or oil, in the high pressure side compression room can be prevented from flowing out to the low pressure side compression room or the back pressure room 12. Accordingly, it is possible to prevent the high pressure side compression room from falling short of oil supply or working fluid having flowed out to the low pressure side compression room from being recompressed to bring down the efficiency of compression.

It is further preferable to so set Communicating Sections A and B that the pressures in the compression rooms 2*a* and 2*b* are higher than that in the back pressure room 12. The reason is that in a pressure state in which the pressures in the compression rooms 2*a* and 2*b* are higher than that in the back pressure room 12, a reverse flow of working fluid, such as gas, from the compression rooms 2*a* and 2*b* to the back pressure room 12 occurs, and therefore the occurrence of this reverse flow should be restrained as far as practicable.

This embodiment is so configured as to keep the total of Communicating Sections A and B in which the two compression rooms 2*a* and 2*b* communicate with the back pressure room 12 at 90° or more (namely, the communicating section of each compression room is 45° or more) to secure a sufficient overall communicating section, and the communicating section of each compression room is set to be less than 180° to prevent the two compression rooms from communicating with the back pressure room 12 at the same time. More preferably, each of Communicating Sections A and B of the compression rooms 2*a* and 2*b* should be wider than 90° and narrower than 180°.

As described so far, this embodiment requires neither an oil feed channel within the scroll lap nor an oil inlet in the upper face of the lap with the result that the strength of the lap is not sacrificed and leak losses from lap tooth tips can be reduced. Also, since oil feed to both the external line side compression room 2*a* and the internal line side compression room 2*b* of the orbiting scroll 6 cam be securely accomplished, short supply of oil can be avoided and the sealing performance between the two scrolls can be enhanced to restrain leak losses of the working fluid during compressing actions. Furthermore, as stabilization of pressure in the back pressure room 12 is made possible to enable the orbiting scroll 6 to be pressed against the fixed scroll 5 with an appropriate force, sliding ease can be increased. Therefore, this embodiment enables a scroll compressor that not only ensures high reliability but also realizes high energy efficiency to be obtained.

Second Embodiment

Figure 11:
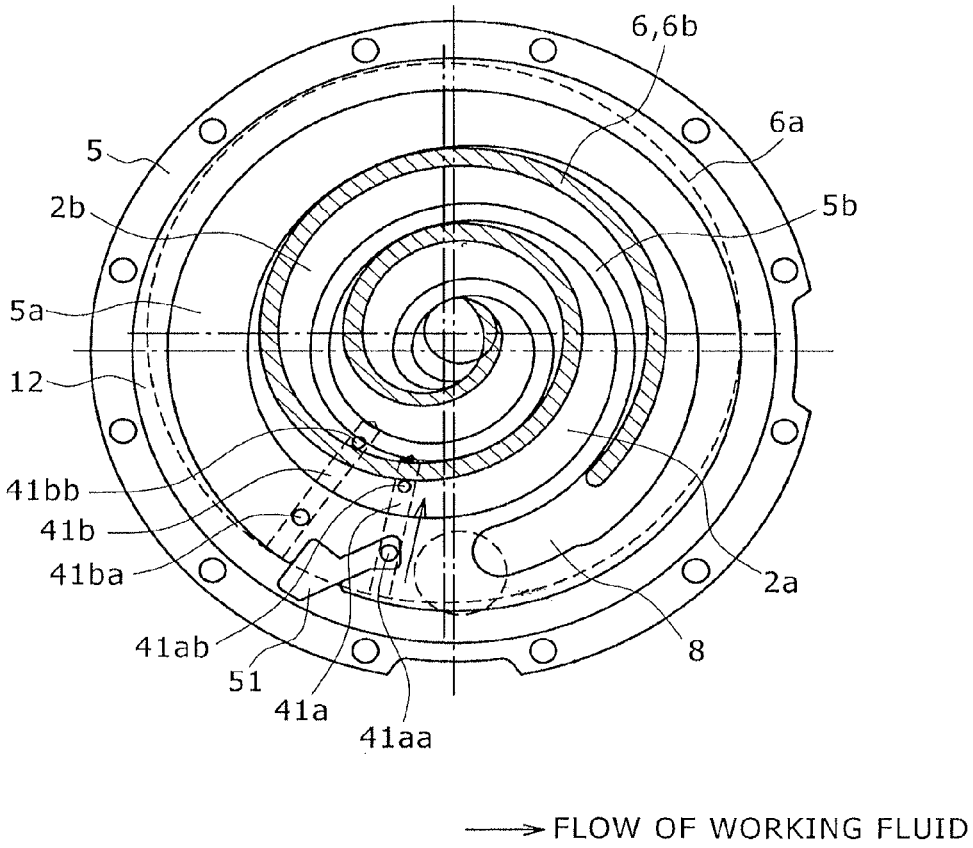
FIG. 11 is a counterpart of FIG. 3 for a scroll compressor as a second embodiment of the invention.
Figure 12:
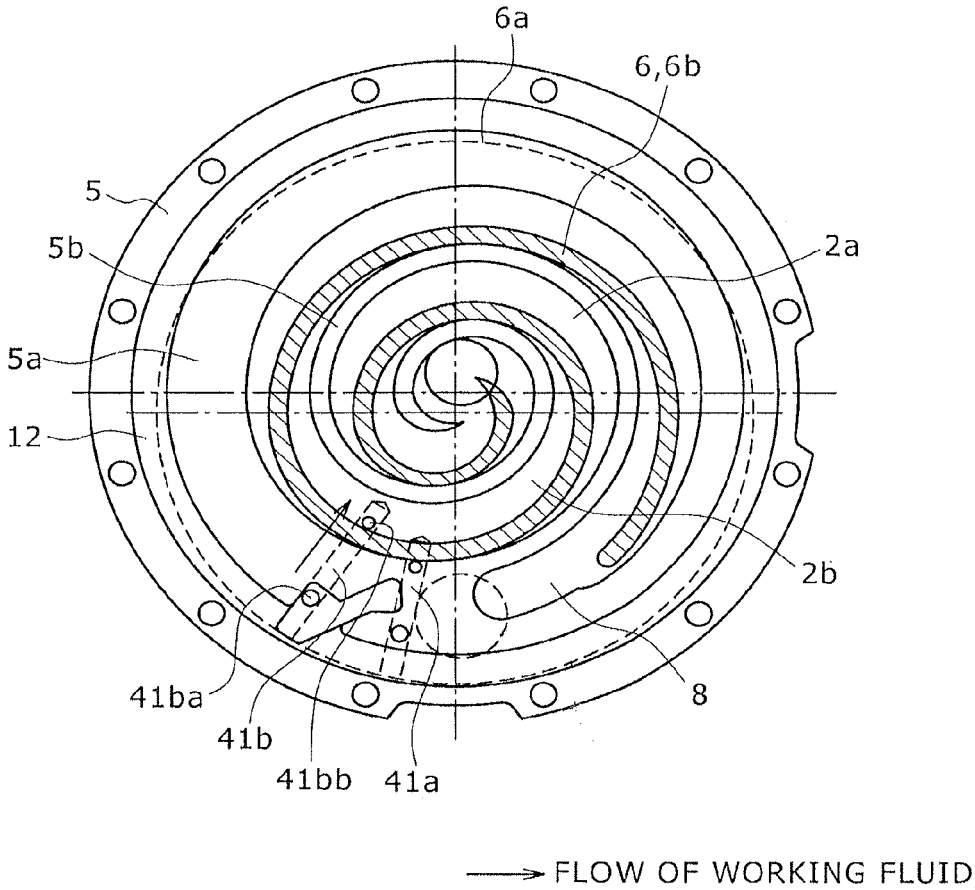
FIG. 12 is a counterpart of FIG. 4 for the scroll compressor as the second embodiment.

A scroll compressor, which is a second embodiment of the present invention, will be described below with reference to FIG. 11 and FIG. 12. In these drawings, parts denoted by the same reference signs as in FIG. 1 through FIG. 4 are respectively the same or corresponding parts, and description of this second embodiment will concentrate on different parts not found in the first embodiment.

The first embodiment described above is an instance in which the fluid effluence channel 41*a* for the external line room and the fluid effluence channel 41*b* for the internal line room, especially their inlet side openings 41*aa* and 41*ba*, are apart from each other at a sufficient distance, with the result that the communicating section control grooves 51 are two separate grooves, which are the communicating section control groove 51*a* for the external line room and the communicating section control groove 51*b* for the internal line room not communicating with each other.

Unlike that, this second embodiment is so configured that the two fluid effluence channel 41*a* and 41*b* are arranged in substantially the same direction, and it is thereby made possible to form the respective inlet side openings 41*aa* and 41*ba* of the two fluid effluence channels 41*a* and 41*b* to be sufficiently close to each other. This configuration enables the communicating section control groove 51*a* for the external line room and the communicating section control groove 51*b* for the internal line room shown in FIG. 3 and FIG. 4 to be formed in close proximity to each other. In view of this point, this embodiment is so configured, as shown in FIG. 11 and FIG. 12, to form the single communicating section control groove 51 for common use by the fluid effluence channel 41*a* for the external line room and the fluid effluence channel 41*b* for the internal line room in the bed plate 5*a* of the fixed scroll 5.

This second embodiment can achieve similar advantageous effects to those of the first embodiment described above and, furthermore, this second embodiment, in which the communicating section control groove that lets the back pressure room 12 and the external line side compression room 2*a* intermittently communicate with each other and the communicating section control groove that lets the back pressure room 12 and the internal line side compression room 2*b* intermittently communicate with each other are combined into the single communicating section control groove 51, has the advantage of reducing the time and cost spent on machining because the communicating section control groove 51 can be formed in a single step of machining.

To add, in this second embodiment, the single communicating section control groove 51 is so formed as to let the inlet side openings 41*aa* and 41*ba* of the two fluid effluence channels 41*a* and 41*b* intermittently communicate with the back pressure room 12 along with the orbiting motion of the orbiting scroll 6. Further, as in the first embodiment, the communicating section control groove 51 is so shaped as to let the two compression rooms 2*a* and 2*b* intermittently communicate with the back pressure room 12, but never at the same time, at similar timing to what is shown in FIG. 7.

Since in each embodiment of the invention, as hitherto described, the fluid effluence channel for the external line side compression room that communicates with the external line side compression room and the fluid effluence channel for the internal line side compression room that communicates with the internal line side compression room are formed on the bed plate of the orbiting scroll, the outlet side opening of each of the fluid effluence channels is so formed as to open in the lap tooth bottom of the orbiting scroll constituting the compression room, the inlet side opening of each of the fluid effluence channels is so formed as to open in the bed plate face of the orbiting scroll that slides in contact with the bed plate sliding face of the fixed scroll, and the communicating section control groove that lets the back pressure room and the external line side compression room intermittently communicate with each other by causing the inlet side opening of the fluid effluence channel for the external line side compression room and the back pressure room to intermittently communicate with each other along with the orbiting motion of the orbiting scroll and the communicating section control groove that lets the back pressure room and the internal line side compression room intermittently communicate with each other by causing the inlet side opening of the fluid effluence channel for the internal line side compression room and the back pressure room to intermittently communicate with each other along with the orbiting motion of the orbiting scroll are provided in the face of the bed plate of the fixed scroll in contact with the orbiting scroll, the following advantageous effects are obtained.

(1) As the outlet side opening of the fluid effluence channel is provided on the tooth bottom (bed plate face), there is no need to form an oil feed channel in the lap of the orbiting scroll, the strength of the lap is not sacrificed, and the reliability of the scroll compressor can be enhanced.

(2) As it is made possible to uniformly feed oil from the back pressure room to both the external line side compression room and the internal line side compression room, short supply of oil can be avoided and the pressure room in the back pressure room can be stably maintained, with the result that the pressing force of the orbiting scroll against the fixed scroll can be controlled at an appropriate level and the sliding ease can also be enhanced. Therefore, a scroll compressor with a high level of energy efficiency and further enhanced reliability can be realized.

What is claimed is:

1. A scroll compressor comprising a fixed scroll and an orbiting scroll each formed by erecting a spiral lap on a bed plate and meshed with each other to form a suction room and a plurality of compression rooms between the two scrolls, the plurality of compression rooms are compressed by reducing its volume by orbiting the orbiting scroll, and a back pressure room whose internal pressure is higher than the pressure in the suction room is disposed on the rear face of the bed plate of the orbiting scroll, wherein:

the lap shapes of the fixed scroll and the orbiting scroll are configured in an asymmetric tooth profile in which an external line side compression room formed on the external line side of the orbiting scroll lap and an internal line side compression room formed on the internal line side of the same differ in orbiting angle at the time of completion of suction;

a fluid effluence channel for the external line side compression room communicating with the external line side compression room of the orbiting scroll lap and a fluid effluence channel for the internal line side compression room communicating with the internal line side compression room of the orbiting scroll lap are formed on the bed plate of the orbiting scroll;

the outlet side opening of each of the fluid effluence channels is so formed as to open in the lap tooth bottom of the orbiting scroll that constitutes the plurality of compression rooms;

the inlet side opening of each of the fluid effluence channels is so formed as to open in the bed plate face of the orbiting scroll that slides in contact with the bed plate sliding face of the fixed scroll;

in the face of the bed plate of the fixed scroll in contact with the bed plate of the orbiting scroll, a communicating section control groove that lets the back pressure room and the external line side compression room intermittently communicate with each other by letting the inlet side opening of the fluid effluence channel for the external line side compression room and the back pressure room intermittently communicate with each other along with the orbiting motion of the orbiting scroll, a communicating section control groove that lets the back pressure room and the internal line side compression room intermittently communicate with each other by letting the inlet side opening of the fluid effluence channel for the internal line side compression room and the back pressure room intermittently communicate with each other along with the orbiting motion of the orbiting scroll are provided, the communicating section control groove that lets the back pressure room and the external line side compression room intermittently communicate with each other and the communicating section control groove that lets the back pressure room and the internal line side compression room intermittently communicate with each other are formed of a common single groove, and the respective inlet side openings of the two fluid effluence channels are separated by a distance that is smaller than a length of a radius of a circumference defined by the bed plate of the orbiting scroll, so that the respective inlet side openings of the two fluid effluence channels are adjacent to one another.

2. The scroll compressor as claimed in claim 1, wherein:

the communicating section control groove is so formed that the back pressure room, the external line side compression room, and the internal line side compression room intermittently communicate with each other in an orbiting angle range in which the pressure in each of the compression rooms is in a target pressure state.

3. The scroll compressor as claimed in claim 1, wherein:

the communicating section control groove is so formed that the external line side compression room and the internal line side compression room do not communicate with the back pressure room at the same time.

4. The scroll compressor as claimed in claim 1, wherein:

a communicating section in which the external line side compression room or the internal line side compression room and the back pressure room intermittently communicate with each other via the fluid effluence channel is 45° or more but less than 180° in orbiting angle.

5. The scroll compressor as claimed in claim 4, wherein:

the communicating section in which the external line side compression room or the internal line side compression room and the back pressure room intermittently communicate with each other via the fluid effluence channel is more than 90° but less than 180° in orbiting angle.

6. The scroll compressor as claimed in claim 1, wherein:

the pressure in the back pressure room is set to be an intermediate pressure lower than the discharge pressure but higher than the suction pressure.

* * * * *